US006330770B1

(12) United States Patent
Fukunaga et al.

(10) Patent No.: US 6,330,770 B1
(45) Date of Patent: Dec. 18, 2001

(54) FREE ACCESS FLOOR

(75) Inventors: Kunihiko Fukunaga; Hironori Oshima; Moritaka Sakamoto, all of Tokyo (JP)

(73) Assignee: Hitachi Kizai, Inc., Tokyo (JP)

( * ) Notice: Subject to any disclaimer, the term of this patent is extended or adjusted under 35 U.S.C. 154(b) by 0 days.

(21) Appl. No.: 09/448,015

(22) Filed: Nov. 23, 1999

(30) Foreign Application Priority Data

Dec. 17, 1998 (JP) ..... 10-375737

(51) Int. Cl.[7] ..... E04C 2/52

(52) U.S. Cl. ..... 52/220.2; 52/220.3; 52/220.5; 52/220.8; 52/263; 174/48

(58) Field of Search ..... 52/220.1, 220.2, 52/220.3, 220.5, 220.7, 220.8, 263, 126.5, 126.6; 174/48, 49; 248/346, 644, 670

(56) References Cited

U.S. PATENT DOCUMENTS 4,901,490 * 2/1990 Zinniel et al. ..... 52/263
5,434,355 * 7/1995 Sho ..... 174/48
5,628,157 * 5/1997 Chen ..... 52/263
5,630,300 * 5/1997 Chen ..... 52/220.5
5,791,096 * 8/1998 Chen ..... 52/126.6
5,901,515 * 5/1999 Chen ..... 52/263
5,904,015 * 5/1999 Chen ..... 52/220.2

* cited by examiner

*Primary Examiner*—Yvonne M. Horton
(74) *Attorney, Agent, or Firm*—Muramatsu & Associates

(57) ABSTRACT

A free access floor eliminates positioning and gluing of support members and simplifies the construction process by automatically positioning the support members. The free access floor includes a plurality of panel support structures, each being formed of a square shaped frame where each of four sides of the frame is formed of a plate member, support units provided at two corners of the square shaped frame for supporting a free access floor panel, and grooves provided on a bottom surface of the support unit where corners of another panel support structure fit in the grooves.

12 Claims, 13 Drawing Sheets

FREE ACCESS FLOOR

FIELD OF THE INVENTION

This invention relates to a free access floor which is built on a concrete surface of a building or other structure, and more particularly to a free access floor where floor panels are supported on panel support structures with a predetermined space between the surface of the concrete floor.

BACKGROUND OF THE INVENTION

Today, in office rooms in a building or the like, various types of information tools such as personal computers, word processors, copy machines, printers and the like are used. In such a situation, various lines and accessories connected to such information tools tend to be disorderly laid on the floors of office rooms. To prevent this, free access floor panels are used on the surface of the concrete floor in a building or other structure with a space therebetween so that the lines and accessories are orderly stored in the space created beneath the free access floor.

An example of such a free access floor which is laid on the base floor with a certain space is shown in FIG. 19. In the conventional free access floor shown in FIG. 19, support members 50 are positioned on a concrete surface 20 in a building or other structure. As shown in FIG. 20, four corners of each free access floor panel 25 are placed on the four support members 50, thereby creating an overall free access floor.

Thus, by storing the various lines and accessories connected to such information tools in the space between the concrete floor 20 and the free access floor panels 25, the office room is cleanly organized without showing the wires and accessories associated with the information tools.

In order to establish the free access floor in the conventional technology, first, a process for determining the positions of the support members 50 is performed on the concrete floor 20 as shown in FIG. 20. In this process, for example, an inked string is extended on the surface of the concrete floor 20 and plunked thereon to draw a line L. By repeating this process, a large number of positioning lines L are illustrated on the concrete surface like a checker pattern, thereby determining the positions of the support members.

Each of the support members 50 is positioned in such a way that center thereof is adjusted to a crossing point of the positioning lines L. Then the bottom surfaces of the support members 50 are attached to the concrete floor 20 through adhesives. The four corners of each of the free access floor panel 25 are placed on the support members 50, thereby creating an overall free access floor.

In the foregoing conventional technology, however, it requires the process of determining the positions of the support members 50 on the concrete floor 20 by using the inked string. Further, the support members 50 have to be glued on the surface of the concrete floor 20. Because the conventional technology requires such processes of positioning and gluing the support members, there is a problem that a relatively long overall construction time is required. Further, an overall cost tends to be increased because of the labor costs involved in such processes.

SUMMARY OF THE INVENTION

Therefore, this invention has been made to solve such a problem involved in the conventional technology. It is an object of the present invention to provide a free access floor in which the conventional processes of positioning and gluing the support members are eliminated, and thus, the construction process is simplified by automatically positioning the support members.

To attain the above object, the free access floor of the present invention is comprised of a plurality of panel support structures,

- each of the panel support structure is formed of a square shaped frame where at least two adjacent sides of the frame is integrally formed of a plate like member.
- support units fixedly and integrally provided at two corners of the square shaped frame for supporting a free access floor panel, and
- grooves provided on a bottom surface of the support unit where each of the grooves has thickness and width which are substantially the same as that of the plate like members of the square shaped frame so that corners of another panel support structure is able to fit in the grooves,
- wherein the plurality of panel support structures are aligned by engaging the grooves of the panel support structure with the corners of other panel support structure at a side without having the support units, thereby positioning the support units to support the free access floor panels thereon.

According to the free access floor of the present invention, the panel support structures are aligned in the vertical and horizontal directions at every other line alternately with the next row. Thus, the panel support structures are connected at the corners of the panel support structure diagonally adjacent with each other by fitting the corners of the frame without having the support units in the grooves of the support unit of the other panel support structure.

DETAILED DESCRIPTIONS OF THE EMBODIMENTS

The embodiments of the present invention will be described below with reference to the accompanying drawings.

The free access floor in the first embodiment of the present invention is explained in the following with reference to FIGS. 1–16.

Figure 1:
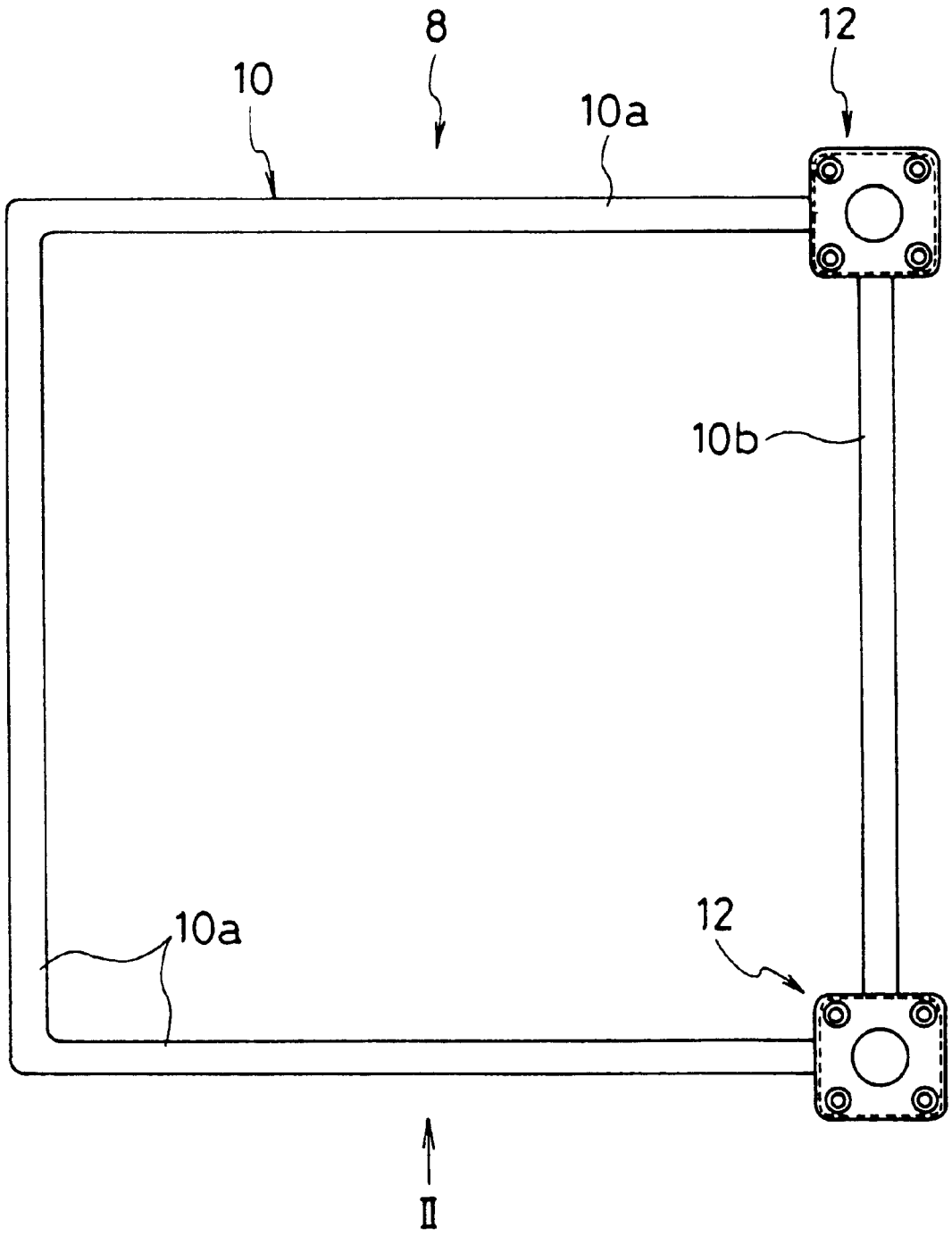
FIG. 1 plan view of the panel support structure 8 in the first embodiment of the free access floor of the present invention.
Figure 2:
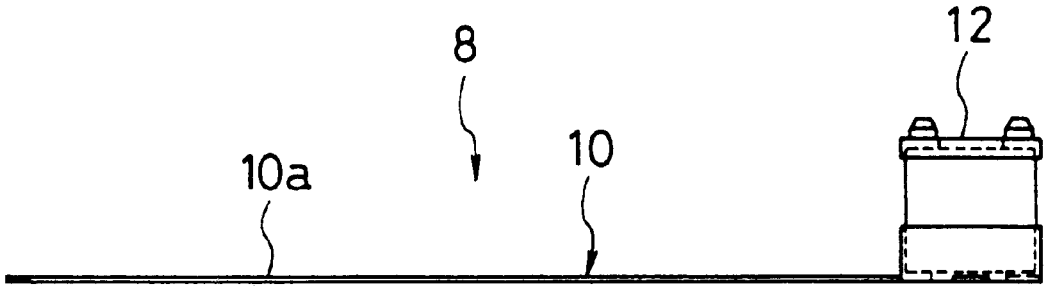
FIG. 2 is a view of the panel support structure 8 of FIG. 1 seen from a direction II of FIG. 1.

FIG. 1 shows a panel support structure 8 for the free access floor of the present invention. The panel support: structure 8 in FIG. 1 includes a square shaped frame 10 having four sides which are formed of plate like members (or plate members) 10*a* and 10*b* made of rigid material such as plastic plate so that the four sides are not easily bent. In this example, at two corners of the square shaped frame 10, support units 12 are provided for supporting free access floor panels 24 as will be described later.

The three plate like members 10*a* of the frame 10 are integrally formed so that the two corners of the frame 10 (left side of FIG. 1) continuously formed at substantially right angle. In the present invention, preferably, at least two adjacent plate like members are integrally formed to achieve sufficient physical strength as well as to maintain the predetermined angle therebetween. At both ends of the three plate like members 10*a* (right side of FIG. 1) are integrally connected to the corresponding bottom portions of the two support units 12. The remaining plate like member 10*b* of the frame 10 is positioned between the two support units 12. The both ends of the plate like member 10*b* are integrally connected to the corresponding bottom portions of the support units 12.

Figure 5:
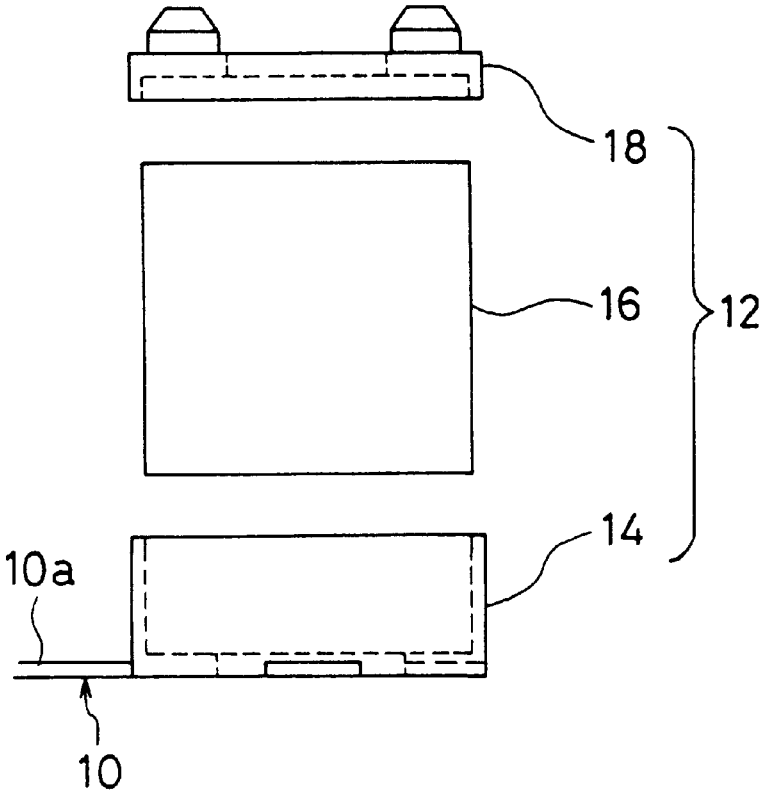
FIG. 5 is an exploded side view of the support unit 12 of FIG. 4.
Figure 6:
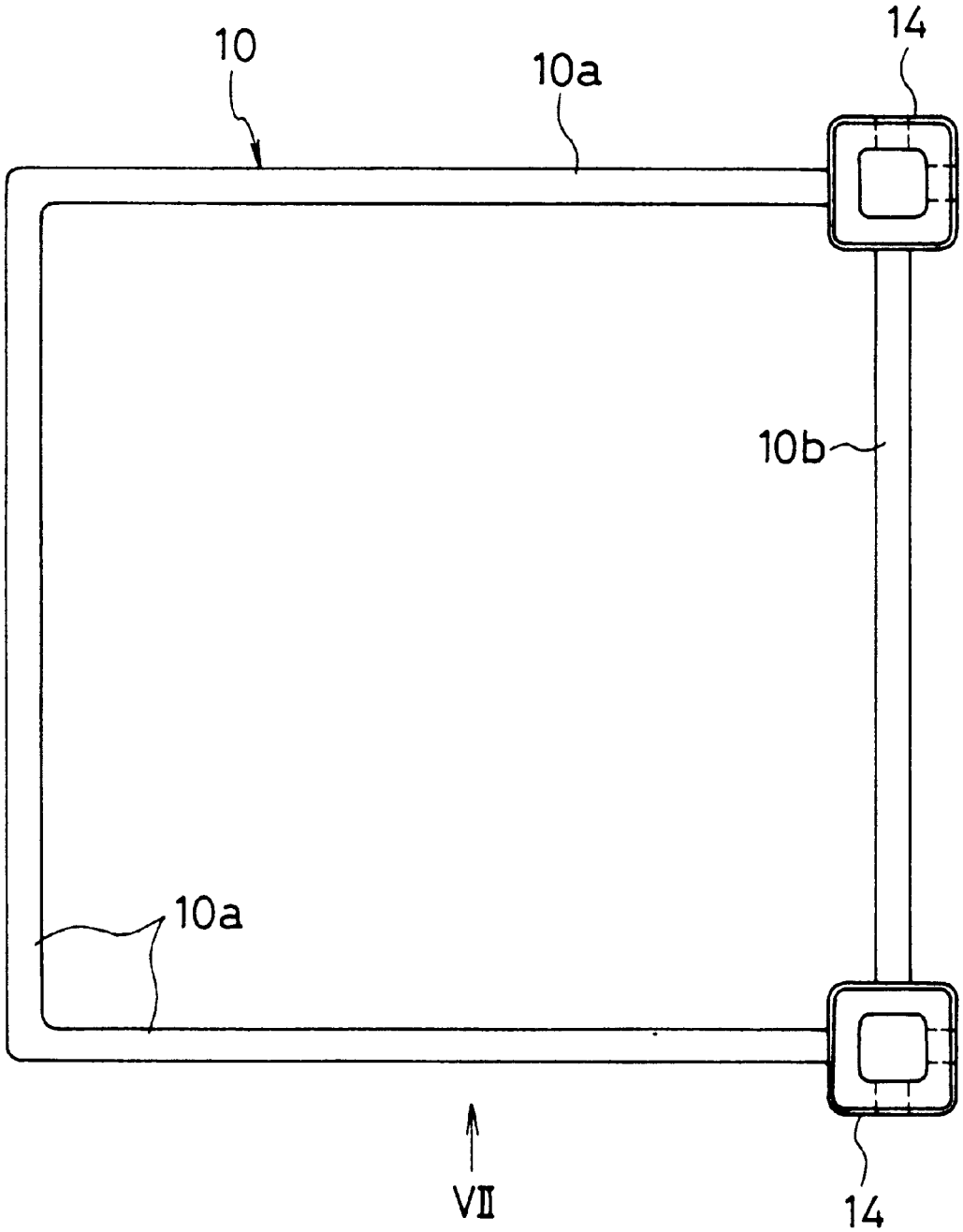
FIG. 6 is a plan view showing a frame 10 formed integrally and support base receptacles 14.
Figure 7:
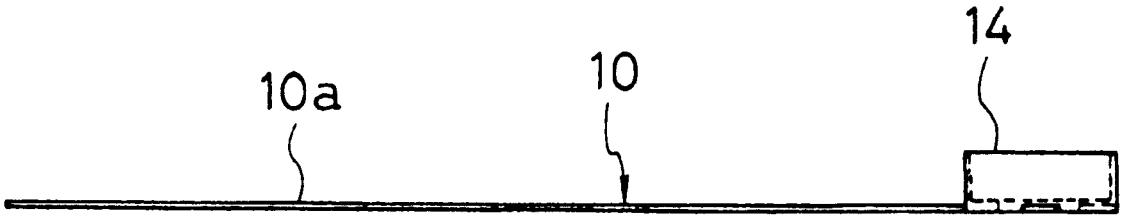
FIG. 7 is a view showing the frame 10 and the support base receptacles 14 seen from a direction VII of FIG. 6.
Figure 9:
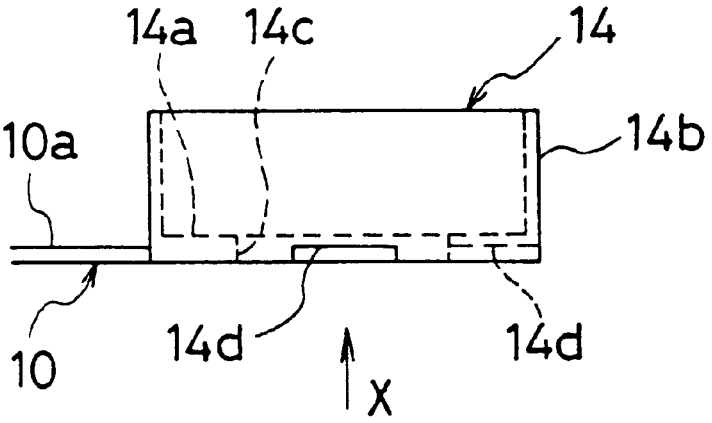
FIG. 9 is a view of the support base receptacle 14 seen from a direction IX of FIG. 8.

As shown in FIG. 5, the support unit 12 is configured by three members including a support base receptacle 14 which is integrally connected to the frame 10, a support base 16 which is received by the support base receptacle 14, a support base cap 18 which covers the support base 16. The support base receptacle 14 is formed of, as shown in FIG. 9, a bottom portion 14*a* having a thickness of slightly larger than that of the frame 10, and a tubular portion 14*b* built on the bottom portion 14*a*.

Figure 8:
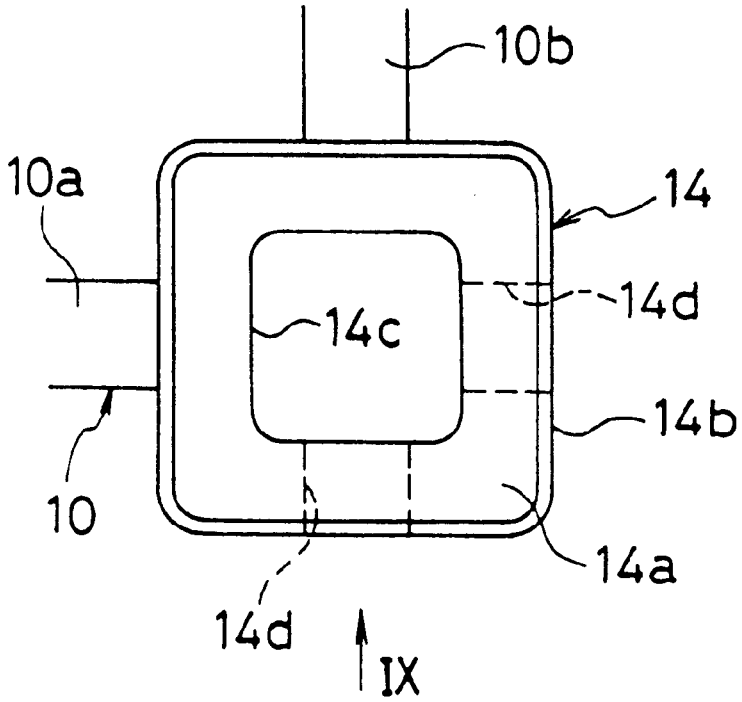
FIG. 8 is an enlarge side view of one of the support base receptacles 14 of FIG. 6.
Figure 10:
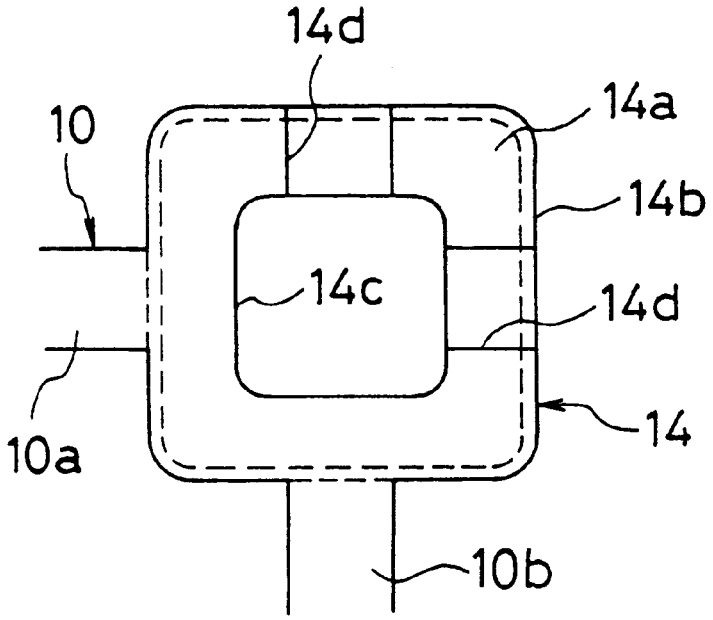
FIG. 10 is a view of the support base receptacle 14 seen from a direction X of FIG. 9.
Figure 11A:
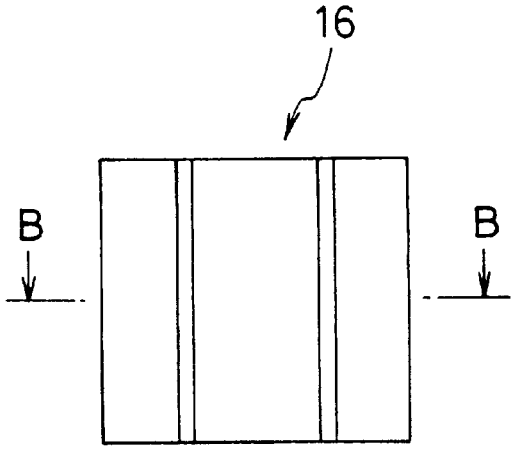
FIG. 11 is directed to a support base 16 in FIG. 5 wherein FIG. 11(*a*) is a side view of the support base 16 and FIG. 11(*b*) is a cross sectional view of the support base 16 taken along B—B line of FIG. 11(*a*).
Figure 11B:
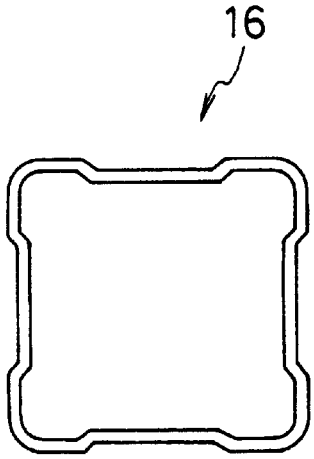

As shown in FIG. 8, the center of the bottom portion 14*a* has a square shaped hole 14*c*. Further, on a bottom surface (which contacts the concrete floor) of the bottom portion 14*a*, grooves 14*d* are provided as shown in FIGS. 8 and 10. The grooves 14*d* are perpendicular to one another in the directions extended from the plate like members 10*a* and 10*b*. The grooves 14*d* have the width and thickness which are substantially equal to the width and thickness of the plate like members 10*a* and 10*b* so that a corner formed of plate like members 10*a* of a frame 10 of another panel support structure 8 is fit in the grooves 14*d*. On the bottom portion 14*a* and within the tubular portion 14*b* of the support base receptacle 14, the support base 16 (shown in FIG. 5) such as shown in FIG. 11 is installed. FIG. 11(*a*) is a side view of the support base 16 and FIG. 11(*b*) is a cross sectional view of the support base 16 taken along B—B line of FIG. 11(*a*). As can be seen in FIG. 11(*b*), each of the four sides of the support base 16 is bent at about the center to improve support strength thereof.

Figure 3:
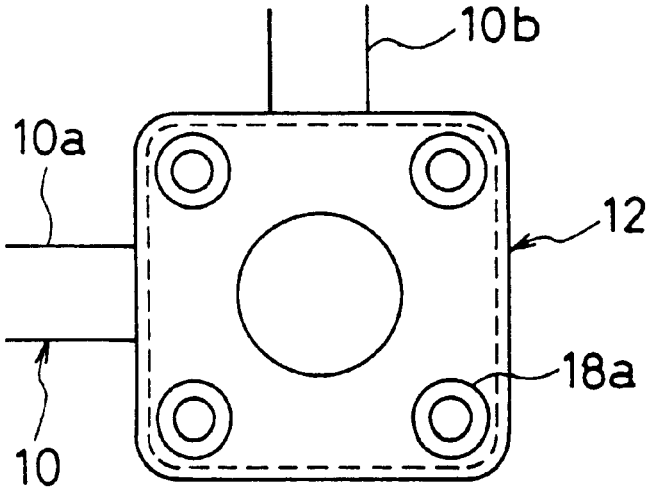
FIG. 3 is an enlarged plan view of one of the support units 12 of the panel support structure 8 of the present invention.
Figure 4:
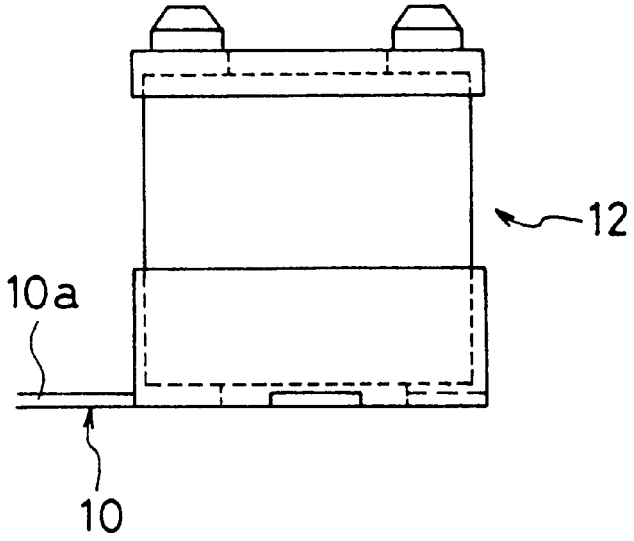
FIG. 4 is an enlarge side view of the support unit 12 of FIG. 2.
Figure 12A:
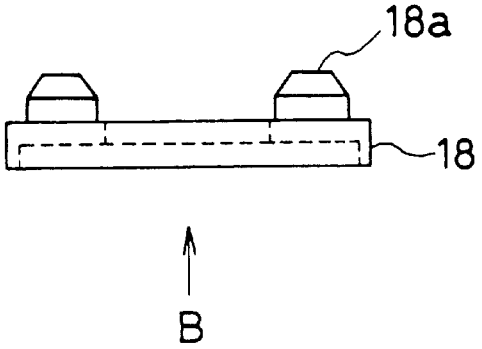
FIG. 12 is directed to a support base cap 18 in FIG. 5 wherein FIG. 12(*a*) is a side view of the support base cap 18 and FIG. 12 (*b*)is a bottom view of the support base cap 18 seen from a section B of FIG. 12(*a*).
Figure 12B:
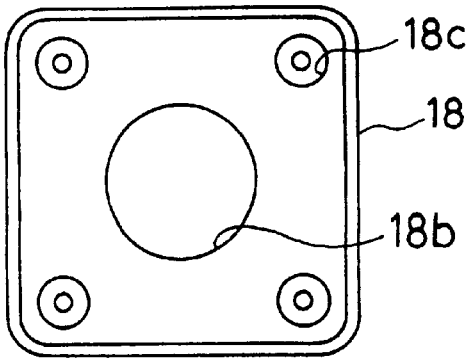

The support base cap 18 (shown in FIG. 5) is placed on the support base 16 to cover the support base as shown in FIG. 12. As shown in FIGS. 3 and 12 (*a*), the support base cap 18 includes a positioning boss 18*a* at each upper corner thereof. A round hole 18*b* is formed at the center of the support base cap 18 and a back of each positioning boss 18*a* is formed of a hole 18c. FIG. 12(*a*) is a side view of the support base cap 18 and FIG. 12 (*b*) is a bottom view of the support base cap 18 seen from a direction B of FIG. 12 (*a*).

Figure 13:
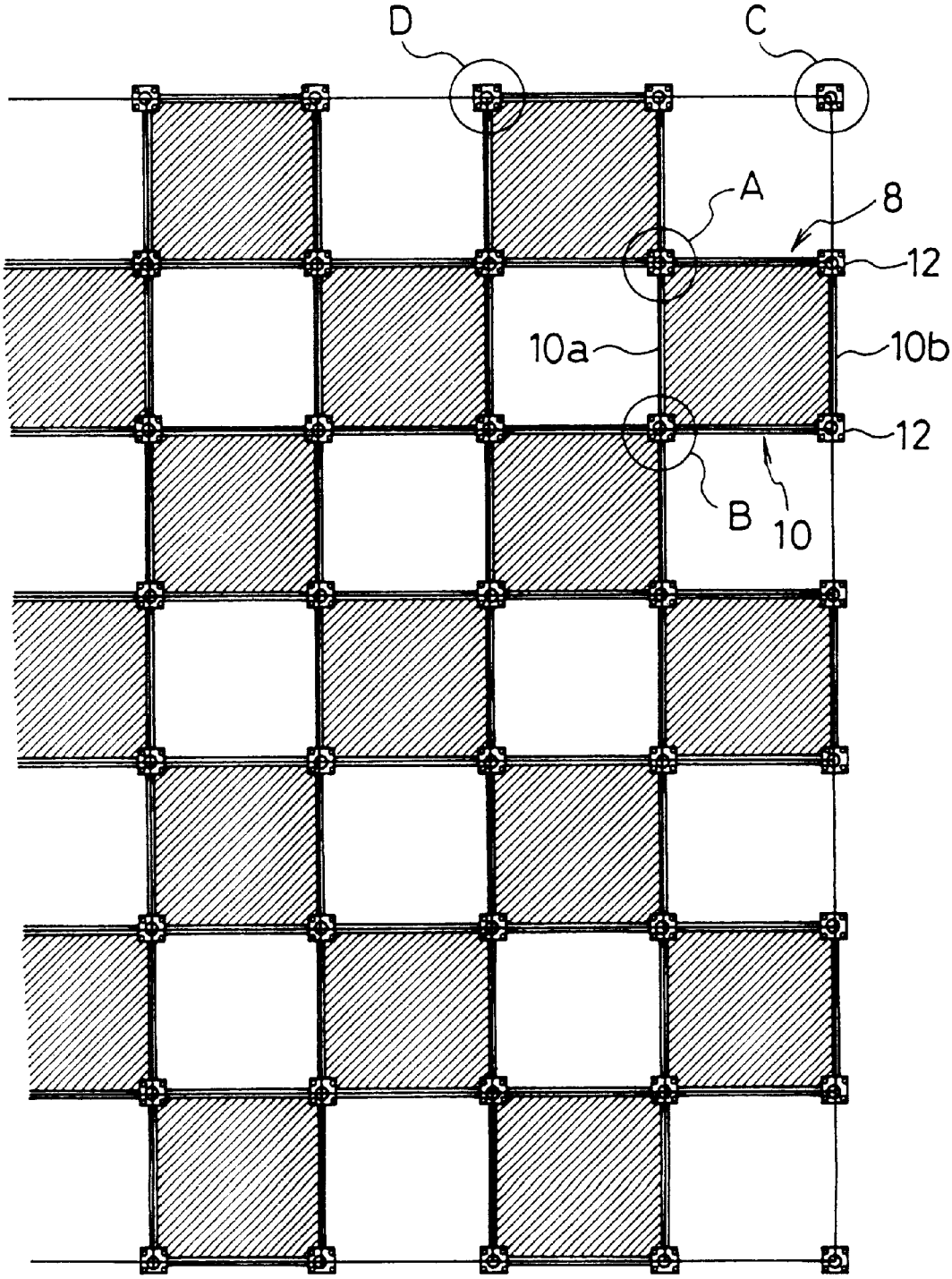
FIG. 13 is a plan view showing the situation where a large number of panel support structures 8 for a free access floor are aligned on the concrete floor.

An assembly process of the panel support members 8 for the free access floor of the present invention is explained in the following:

FIG. 13 shows a situation where a large number of panel support structures 8 for the free access floor are aligned on the concrete floor. Thus, the assembly process of the panel support structures 8 is described with reference to FIG. 13. The panel support structures 8, each having the support units 12 at the both ends of the plate like member 10*b* are aligned in a vertical direction at the right end of FIG. 13.

Figure 14:
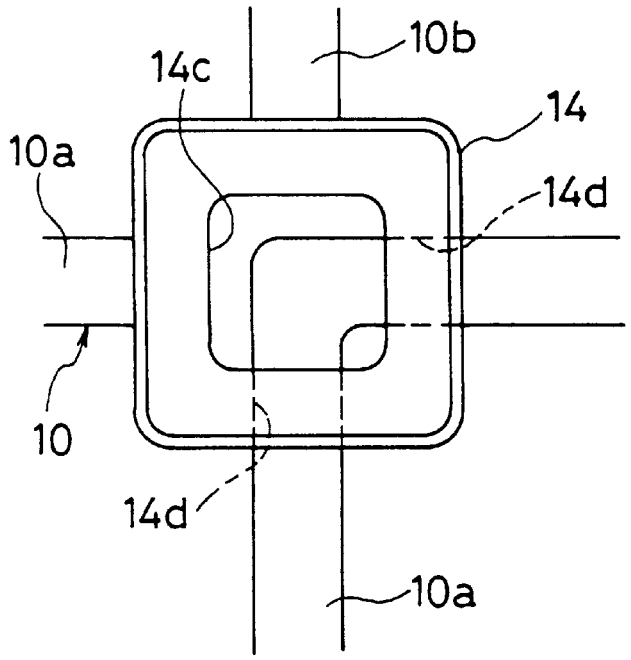
FIG. 14 is an enlarged plan view showing a situation where the corner of plate like member 10*a* of the frame 10 of the panel support structures 8 denoted by a circle A in FIG. 13 is fit in the grooves 14*d* of the support base receptacle 14 of the other panel support structure 8 diagonally adjacent to each other.

At the corner of the panel support structures 8 denoted by a circle A in FIG. 13, two panel support structures 8 diagonally adjacent to each other are connected as shown in FIG. 14. Namely, the corner of the frame 10 of the panel support structure 8 positioned in the lower right of FIG. 14 is fit in the grooves 14d on the support base receptacle 14 of the panel support structure 8 positioned in the upper left of FIG. 14.

Figure 15:
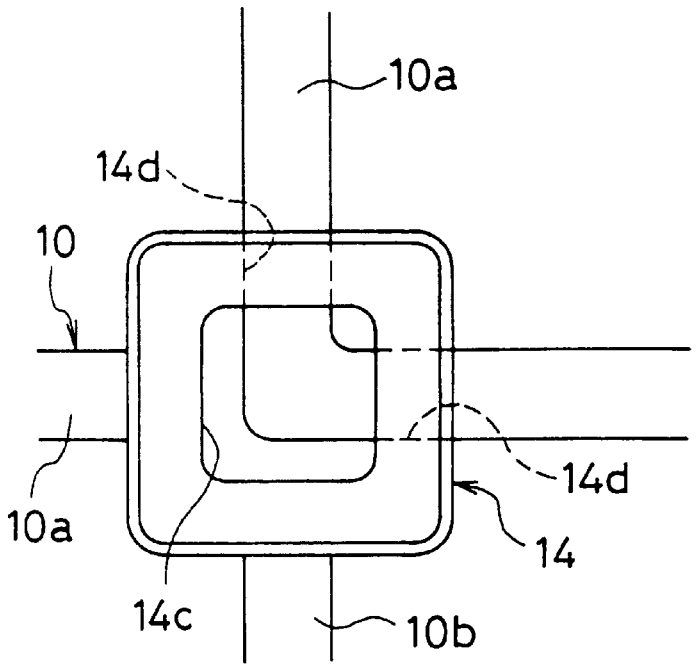
FIG. 15 is an enlarged plan view showing a situation where the corner of plate like member 10*a* of the frame 10 of the panel support structures 8 denoted by a circle B in FIG. 13 is fit in the grooves 14*d* of the support base receptacle 14 of the other panel support structure 8 diagonally adjacent) to each other.
Figure 16:
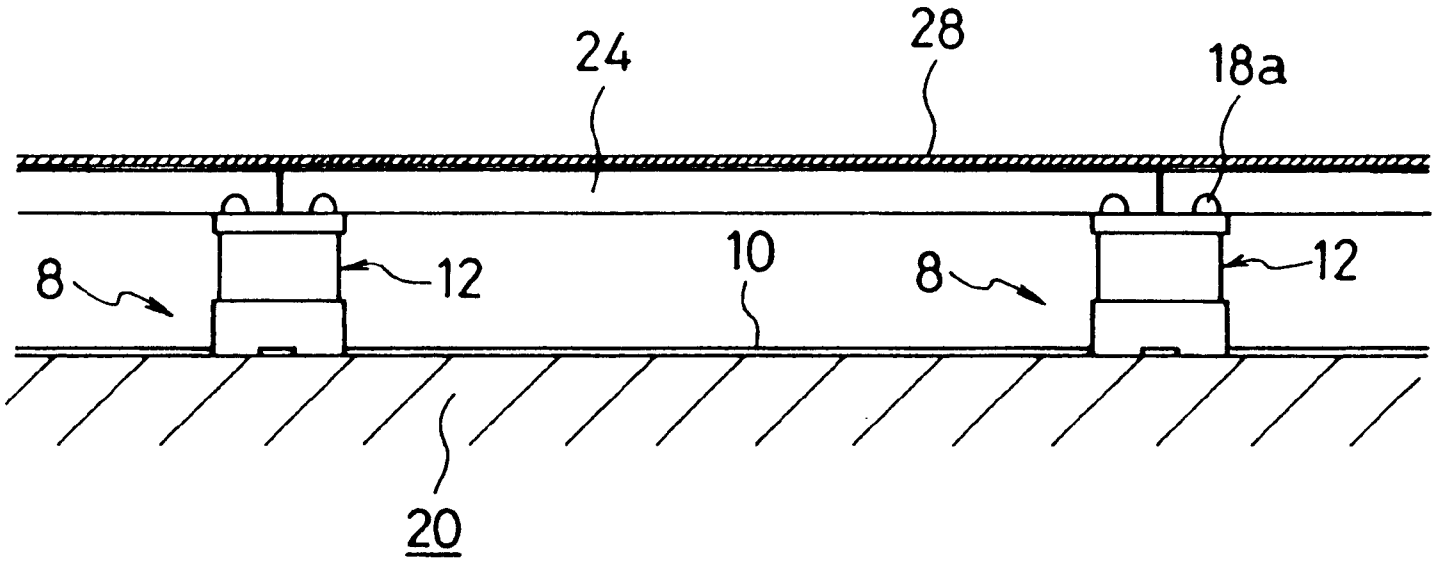
FIG. 16 a side view showing the situation where free access panels 24 are placed on the support units 12 of the panel support structures 8 to form a free access floor and where a carpet 28 is laid on the free access floor.

As shown in FIG. 13, at the corner of the panel support structure 8 denoted by a circle B, two panel support structures 8 diagonally adjacent to each other are connected as shown in FIG. 15. Namely, the corner of the frame 10 of the panel support structure 8 positioned in the upper right of FIG. 15 is fit in the grooves 14*d* on the support base receptacle 14 of the panel support structure 8 positioned in the lower left of FIG. 14.

In this manner, the panel support structures 8 are aligned in the vertical and horizontal directions in every other line of FIG. 13. Thus, the panel support structures 8 are connected at the corners of the panel support structure diagonally adjacent with each other by fitting the corner of the frame 10 in the grooves 14*d* of the support unit 12 of the other panel support structure. Thus, the panel support structures are connected in a manner shown in FIG. 13 without the process of illustrating the position lines by ink on the concrete surface or gluing the support members to the concrete floor. Accordingly, the positioning of the support units 12 are easily completed without any specific labor work for determining the positions.

Like in the positions denoted by circles C and D, there arise a situation where the support unit 12 may not be properly provided at such a location. In such a location, a support unit 12 having the grooves 14*d* at the support base receptacle without having the frame 10 is connected to the other panel support structure 8, thereby establishing the support units 12 at all of the corners of the floor panels.

It should be noted that, in FIG. 13, although the hatched lines are provided to show the locations of the panel support structures 8, in reality, this hatched portions are blank and thus the concrete surface is visible therethrough.

On the support units 12 of the large number of panel support structures 8 assembled in the process noted above, as shown in FIG. 16, the free access floor panels 24 are placed on the support units 12 of the panel support structures 8. The floor panel 24 is placed on the support structures 8 in such a way that each positioning boss 18*a* on the support base cap 18 is engaged with a corresponding recess provided on the floor panel 24. By fitting the four corners of all of the floor panels 24 with the support units 12, a free access floor is completed. A carpet may be laid on the free access floor to finalize the office floor.

As in the foregoing, the panel support structures 8 are aligned in the vertical and horizontal directions at every other line alternately with the next row. Thus, the panel support structures 8 are connected at the corners of the panel support structure diagonally adjacent with each other by fitting the corners of the frame 10 without having the support units 12 in the grooves 14*d* of the support unit 12 of the other panel support structure. Thus, the present invention makes it possible to easily position the support units 12 for supporting the free access floor panels 24.

As a consequence, the process for positioning the support units such as drawing the positioning lines and the process for bonding the support members in the conventional technology are unnecessary in the present invention, resulting in the simplicity of construction works, reduction of construction time and accordingly reduction of cost.

Further, the support base receptacle 14 of the support unit 12 of the panel support structure 8 has a hole at its center. Similarly, the support base 16 and the support base cap 18 also have holes at the center thereof. Therefore, the corner of the frame 10 of the other panel support structure 8 is visible through the holes, thereby being able to easily determine whether the plate like members 10*a* are provided in the intended location under the support base receptacle 14 and are properly engaged with the grooves 14*d* of the support base receptacle 14.

Moreover, since the different sizes of the frame 10 of the panel support structure 8 can be easily made depending on the size of the free access floor panel 24, the present invention can be applied to any sizes of free access floor panels 24.

Figure 17:
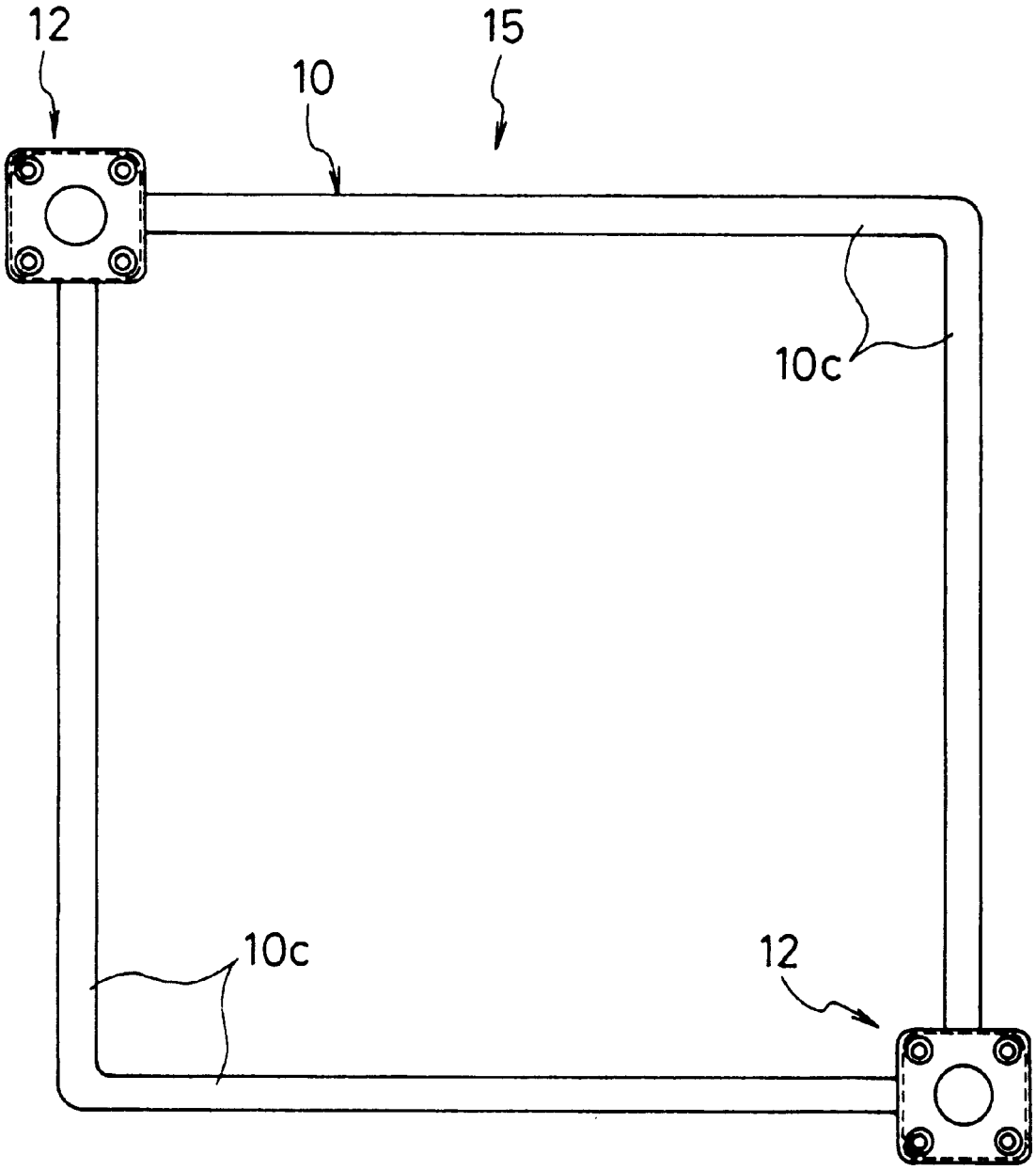
FIG. 17 is a plan view of the panel support structure 15 in the second embodiment of the free access floor of the present invention.

FIG. 17 is directed to the second embodiment of the panel support structure 15 to be used in the free access floor of the present invention. In the first embodiment described in the foregoing, two support units 12 are provided at one side of the frame 10, i.e, both ends of the plate like member 10*b*. In the second embodiment, two support units 12 are provided at the ends of two L shaped members 10*c* of the frame 10 on a diagonal line. The panel support structure 15 in the second embodiment can achieve the same effect as that of the first embodiment.

Figure 18:
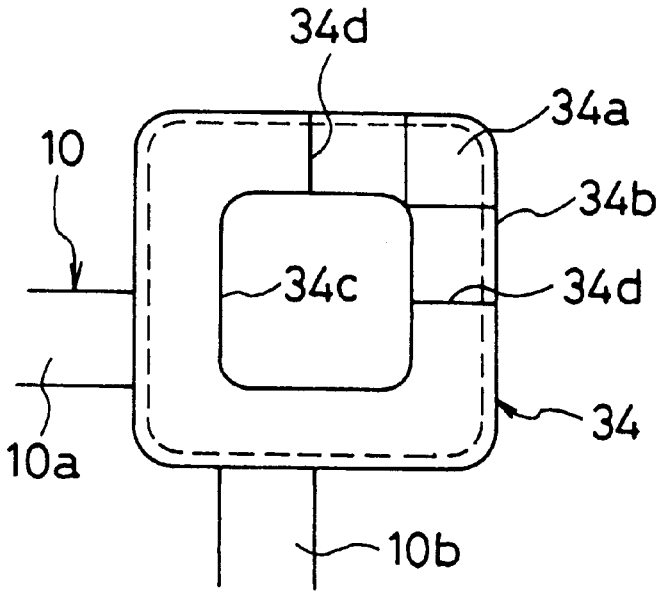
FIG. 18 is a bottom view of the support base receptacle 34 in the third embodiment of the free access floor of the present invention.
Figure 19:
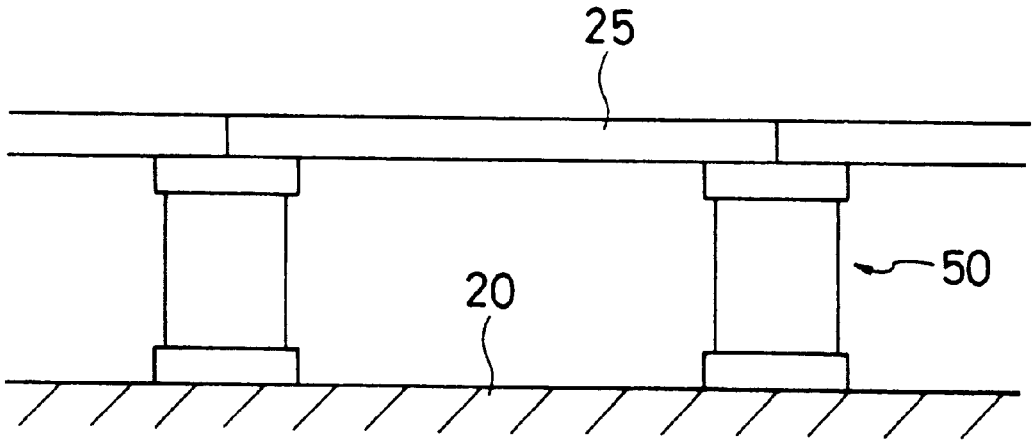
Fig. 19 (Prior Art)
FIG. 19 a side view showing the conventional free access floor where free access floor panels 25 are supported on support members 50.
Figure 20:
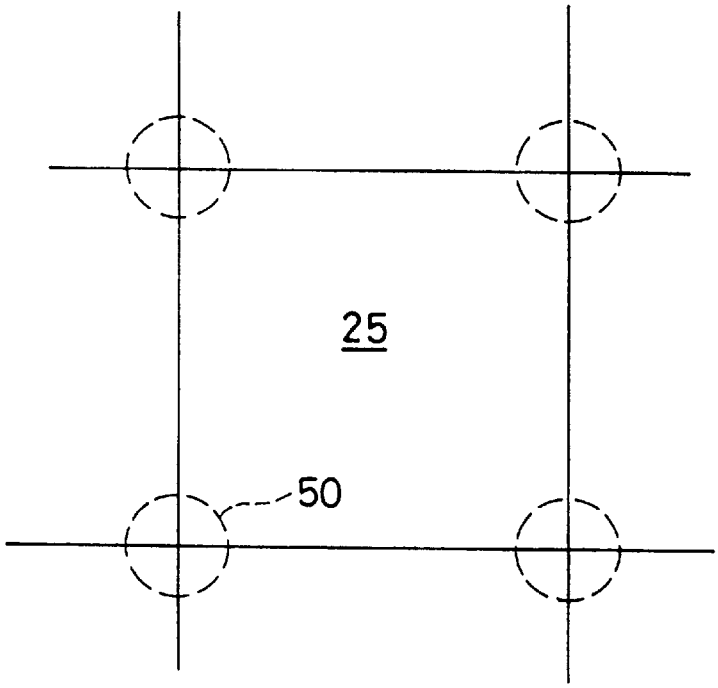
Fig. 20 (Prior Art)
FIG. 20 is a plan view of the free access floor panel 25 supported by the support members 50 of FIG. 19.
Figure 21:
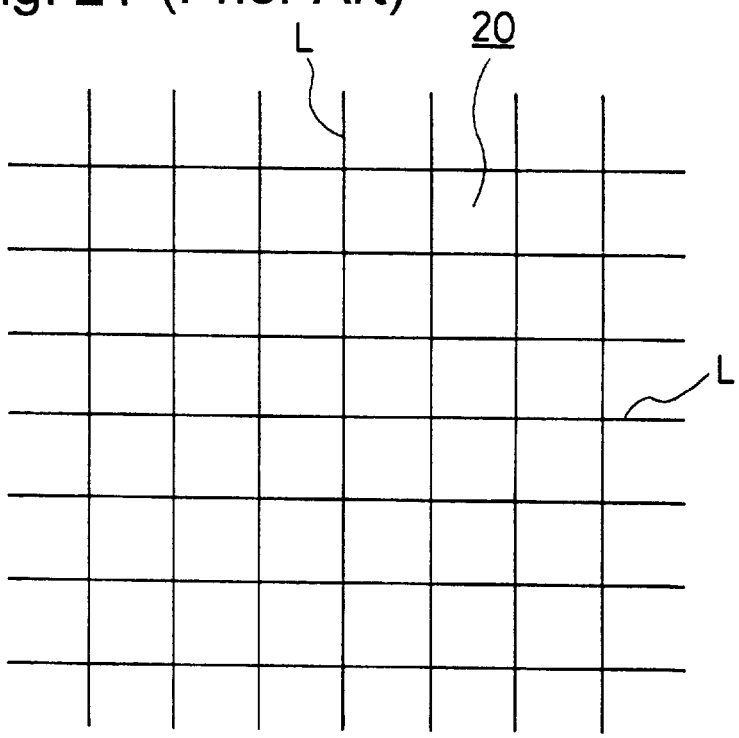
Fig. 21 (Prior Art)
FIG. 21 is a plan view showing the positioning lines L illustrated on the concrete floor 20 for positioning the support members 50 of FIG. 19.

FIG. 18 is directed to the third embodiment of the present invention. In the first embodiment described in the foregoing, the grooves 14*d* on the bottom surface of the support base receptacle 14 are formed in the directions which are extension of the frame 10 which is integrally formed with the support base receptacle 14. In the third embodiment, grooves 34*d* on a support base receptacle 34 are shifted their position from the extension of the frame 10 and integrally formed with the support base receptacle 34. The structure in the third embodiment can achieve the same effect as that of the first embodiment.

In the foregoing explanation, the support units 12 have the identical height to one another. However, the present invention can be applied to the support units whose height can be adjustable.

In the present invention, the panel support structures are aligned in the vertical and horizontal directions at every other line alternately with the next row. Thus, the panel support structures are connected at the corners of the panel support structure diagonally adjacent with each other by fitting the corners of the frame without having the support units in the grooves of the support unit of the other panel support structure. Thus, it is possible to easily determine the positions of the support units for supporting the free access floor.

As a consequence, the processes for positioning the support units such as drawing the positioning lines and for bonding the support members can be eliminated resulting in the simplicity of construction works and reduction of construction time and cost.

What is claimed is:

1. A free access floor formed on a base floor with a predetermined space therebetween, comprising:

a plurality of panel support structures, each panel support structure is comprised of:

a square shaped frame where at least two adjacent sides of the frame are integrally formed of a plate member;

support units integrally provided at two corners of the square shaped frame for supporting a free access floor panel; and grooves provided on bottom surfaces of the support units, each of the grooves having a thickness and a width substantially the same as that of the plate members of the square shaped frame so that corners of another panel support structure are able to fit in the grooves;

wherein the plurality of panel support structures are adapted to be aligned on the base floor by engaging the grooves of the support units of the panel support structure with the corners of the square shaped frame of another panel support structure at a side where there are no support units in such a way to receive the corners of the square shaped frame of another panel support structure in the grooves, thereby positioning the support units to support the free access floor panels thereon.

2. A free access floor as defined in claim 1, wherein the support units are respectively provided at two adjacent corners of the square shaped frame.

3. A free access floor as defined in claim 1, wherein the support units are respectively provided at two corners of the square shaped frame positioned diagonally with one another.

4. A free access floor as defined in claim 1, wherein the plate members are made of plastic material which is not easily bent.

5. A free access floor as defined in claim 1, wherein each of the support units is comprised of a support base receptacle integrally formed with the square shaped frame, a support base which is placed on the support base receptacle for supporting the free access floor panel, and a support base cap for covering a top of the support base.

6. A free access floor as defined in claim 5, wherein the support base receptacle has a thickness slightly larger than that of the plate members and has a hole at about a center thereof, the support base receptacle being formed of a bottom portion having a bottom surface and a tubular portion integrally formed on an outer end of the bottom portion.

7. A free access floor as defined in claim 6, wherein the support base is received by the tubular portion of the support base receptacle at a lower position thereof, each side wall of the support base being bent at about the center thereof.

8. A free access floor as defined in claim 7, wherein the support base cap covering the support base has a positioning boss at each of four upper corners thereof for positioning the free access floor panel and a hole at a center thereof for monitoring the square shape frame when assembling the panel support structures.

9. A free access floor as defined in claim 1, wherein the panel support structures are adapted to be aligned on the base floor of a building in vertical and horizontal directions at every other line alternately with a next row by connecting the corners thereof with one another.

10. A free access floor as defined in claim 9, wherein support units, without being connected to the square shaped frame, are placed at corners of the square shaped frames of the panel support structures adapted to be aligned on the base floor of the building, where there are no support units, by fitting the corners of the square shaped frames in the grooves of the support units.

11. A free access floor as defined in claim 8, wherein each of the four positioning bosses on the support base cap is engaged with a corresponding recess provided on one of four floor access floor panels, thereby accurately positioning the free access floor panels on the panel support structures.

12. A free access floor as defined in claim 5, wherein the height of the support unit of the panel support structure is adjustable to be different from that of the other support unit.

* * * * *